US005667634A

United States Patent [19]

Fujita et al.

[11] Patent Number: 5,667,634

[45] Date of Patent: Sep. 16, 1997

[54] METHOD FOR CONTROLLING PITCH DEPOSITS IN PAPERMAKING PROCESS USING LIPASE AND POLYELECTROLYTE

[75] Inventors: Yuko Fujita, Tokyo; Haruo Awaji, Saitama-ken; Hidesato Shimoto; Masaki Sharyou, both of Chiba-ken, all of Japan

[73] Assignee: Novo Nordisk A/S, Bagsvaerd, Denmark

[21] Appl. No.: 271,274

[22] Filed: Jul. 6, 1994

Related U.S. Application Data

[63] Continuation of Ser. No. 122,435, which is a continuation-in-part of PCT/DK92/00137 filed on Apr. 30, 1992, abandoned.

[30] Foreign Application Priority Data

May 1, 1991 [EP] European Pat. Off. ..... 91610037

[51] Int. Cl.[6] ..... D21C 9/08; C12P 7/62

[52] U.S. Cl. ..... 162/72; 162/199; 162/DIG. 4; 435/278

[58] Field of Search ..... 162/72, 164.6, 162/168.2, 199, DIG. 4; 435/277, 278

[56] References Cited

U.S. PATENT DOCUMENTS

| | | | |
|---|---|---|---|
| 4,184,912 | 1/1980 | Payton | 162/72 |
| 4,190,491 | 2/1980 | Drennen et al. | 162/76 |
| 4,913,775 | 4/1990 | Langley et al. | 162/164.3 |
| 5,176,796 | 1/1993 | Ine et al. | 162/174 |
| 5,256,252 | 10/1993 | Sarkar et al. | 162/72 |

FOREIGN PATENT DOCUMENTS

| | | |
|---|---|---|
| 0 374 700 | 6/1990 | European Pat. Off. . |
| 1189604 | 4/1970 | United Kingdom . |

OTHER PUBLICATIONS

Y. Irie et al., "Enymatic Pitch Control in Papermaking System", 1990 Papermakers Conference, pp. 1–10.

K. Gibson, "Applications of Lipase Enzymes in Mech Pulp Production", 1991 Pulping Conference, pp. 1–6.

Kwon et al., Chem. Abs. No. 234795t, vol. 107, No. 25, p. 631 (1987).

*Primary Examiner*—Donald E. Czaja
*Assistant Examiner*—Dean T. Nguyen
*Attorney, Agent, or Firm*—Steve T. Zelson; Cheryl H. Agris

[57] ABSTRACT

Addition of a water-soluble polyelectrolyte (i.e. an anionic or cationic polymer) significantly increases the hydrolysis rate of esters in the presence of lipases. The invention provides a process for hydrolysis of water-insoluble ester in the presence of a lipase characterized by the presence of a water-soluble polyelectrolyte. The invention also provides a method of increasing the rate of hydrolysis of water-insoluble ester in the presence of a lipase by incorporation of a water-soluble polyelectrolyte.

10 Claims, No Drawings

METHOD FOR CONTROLLING PITCH DEPOSITS IN PAPERMAKING PROCESS USING LIPASE AND POLYELECTROLYTE

This application is a continuation application of application Ser. No. 08/122,435, filed Sep. 24, 1993, now abandoned, the contents of which are incorporated herein by reference and a continuation of PCT/DK92/00137 filed on Apr. 30, 1992.

TECHNICAL FIELD

This invention relates to a process for hydrolysis of water-insoluble ester in the presence of a lipase, particularly to such a process for hydrolysis of pitch (resin) in pulp, and to a method of increasing the rate of hydrolysis of water-insoluble ester in the presence of a lipase by incorporation of a polyelectrolyte.

BACKGROUND ART

It is known that lipases can be used with advantage for efficient hydrolysis of water-insoluble esters, particularly triglycerides (e.g. JP-A 51-080305, JP-A 58-126794, JP-A 59-210893, GB-A 2,176,480, WO 88/02775).

It is also known that some types of pulp made from wood have a high pitch content, e.g. various types of mechanical pulp. This can cause so-called pitch troubles in papermaking such as paper contamination or paper breaks. Pitch contains considerable amounts of triglycerides, more commonly known as fats, and other esters.

It is the object of this invention to provide an improved process for ester hydrolysis, applicable to hydrolysis of resin esters.

STATEMENT OF THE INVENTION

We have found that, surprisingly, addition of a water-soluble polyelectrolyte (i.e. an anionic or cationic polymer) significantly increases rate of esters in the presence of lipases.

Various metal cations have been reported to affect lipase activity, and cationic surfactant has been reported inhibit lipase activity (Nishio et al., *Agric. Biol. Chem.*, 51 (1), 181–186, 1987; C. E. Ibrahim et al., *Agric. Biol. Chem.*, 51 (1), 37–45, 1987). The effect of polyelectrolytes on lipase activity has not been described.

Accordingly, the invention provides a process for hydrolysis of water-insoluble ester in the presence of a lipase, characterized by the presence of a water-insoluble polyelectrolyte. The invention also provides a method of increasing the rate of hydrolysis of water-insoluble ester in the presence of a lipase by incorporation of a water-soluble polyelectrolyte.

DETAILED DESCRIPTION OF THE INVENTION

Polyelectrolyte

The polyelectrolyte used in the invention may be any water-soluble polymer that contains functional groups which ionize in water. It may be cationic or anionic. A group of preferred anionics is anionic polyacrylamide, e.g. a copolymer of acrylamide and acrylate (such as sodium acrylate).

Some preferred cationic polymers are those containing tertiary or quaternary amine groups. An example is cationic starch having diethylamino-ethyl groups or 2-hydroxy,2-(trimethylamino-methyl)ethyl groups attached to the hydroxyl group in the 6-position of the repeating glucose unit of the starch molecule.

Another example is cationic polyacrylamide, e.g. a copolymer of acrylamide with N-(dimethyl-amino-methyl)-acrylamide, dimethyl-amino-ethyl methacrylate or trimethyl-amino-ethyl methacrylate. A further example is cationic polyamine such as quaternary polyamine and polyethyleneimine.

Use of the above-mentioned polyelectrolytes is particularly advantageous in papermaking where these polymers may simultaneously act flocculants or retention aids.

The amount of polyelectrolyte is preferably 2–1000 ppm, preferably 10–200 ppm in the reaction mixture, or 0.1–10 kg/ton of dry matter, particularly 0.3–3 kg/t.

Lipase

For reasons of economy, microbial lipases are preferred. Examples of suitable enzymes are lipases derived from strains of Pseudomonas (especially *Ps. cepacia, Ps. fluorescens, Ps. fragi* and *Ps. stutzeri*), Candida (especially *C. antarctica* (e.g. lipase A or B, see WO 88/02775) and *C. cylindracea*), Humicola (especially *H. brevispora, H. lanuginosa, H. brevis var. thermoidea* and *H. insolens*), Chromobacterium (especially *C. viscosum*) and Aspergillus (especially *A. niger*).

The amount of lipase will typically correspond to a lipase activity of 1,000–100,000 LU/kg dry matter or 50–5,000 LU/litre (LU=Lipase Unit, defined in WO 89/04361).

Ester Hydrolysis Process

Typical process conditions are pH 3–7.5, particularly 4–7, a temperature from ambient to 80° C., particularly 30°–60° C., and reaction times of 0.5–3 hours.

The process of the invention can be used for any lipase-catalyzed hydrolysis of water-insoluble esters, particularly triglycerides.

Thus, the process of the invention may be used for fat hydrolysis in the production of fatty acids, glycerides and/or glycerol from fat or oil. The ester may be a liquid at ambient temperature, such as soy bean oil and many other oils, or it may be a high melting fat, such as beef tallow.

Hydrolysis of Resin Esters

The process of the invention is particularly applicable to the hydrolysis of resin esters during a pulping or papermaking process, e.g. to avoid pitch troubles such as paper contamination, paper breaks or contamination of process equipment.

The process of the invention may be applied to any pitch-containing pulp, especially to pulps with a considerable content of triglycerides and other esters from pitch. Examples are pulps produced by mechanical pulping, alone or combined with a gentle chemical treatment, such as GW (Ground Wood), TMP (Thermo Mechanical Pulp) and CTMP (Chemical Thermo Mechanical Pulp).

Hydrolysis of esters in pitch according to the invention can be done in the pulping or stock preparation section, where addition of polyelectrolytes is particularly advantageous since it can also act as a retention or flocculation aid. The pulp typically has a consistency of 0.2–5% dry substance.

EXAMPLES

Example 1

Red pine (*Pinus radiata*) ground wood pulp was treated with Humicola lipase in the presence of various polyelectrolytes. After the reaction the degree of triglyceride hydrolysis was determined by quantitative TLC using Iatroscan™.

Conditions were: 4% pulp slurry, pH 4.5, temperature 40° C., agitation 300 rpm. The dosage of polyelectrolyte and enzyme is given below as ppm/DS. Results:

| Polyelectrolyte | Dosage of poly. (ppm/DS) | Dosage of Lipase (ppm/DS) | Relative Amount of Triglycerides (*) (%) |
|---|---|---|---|
| None (control) | 0 | 1000 | 100 |
| Anionic, High Molecular Polyacrylamide-copolymer | 1000 | 1000 | 79 |
| Cationic, High Molecular Polyacrylamide-copolymer | 1000 | 1000 | 67 |
| Strongly Cationic, High Molecular Polyacrylamide-copolymer | 1000 | 1000 | 64 |
| Quaternary Polyamine | 1000 | 1000 | 67 |
| Cationic Polymer | 1000 | 1000 | 71 |

(*): Determined by quantitative TLC; Iatroscan Method.

It is seen that all the anionic and cationic polymers tested increased the hydrolysis of triglyceride.

Example 2

To verify the effect of polyelectrolytes on lipase activity another experiment was done, using two different cationic polymers. Conditions were: 4% pulp slurry, pH 4.5, temperature 40° C., 2 hours reaction time, agitation 300 rpm. Dosage of polyelectrolytes and enzyme are given below as ppm/DS.

| Dosage (ppm/DS) of | | Dosage (ppm/DS) | Relative amount |
|---|---|---|---|
| Cationic Polyner | Quarternary Polyamine | of Lipase | Triglycerides (%) |
| 0 | 0 | 0 | 100 |
| 0 | 0 | 1000 | 45 |
| 1000 | 0 | 1000 | 36 |
| 1000 | 0 | 0 | 100 |
| 0 | 1000 | 1000 | 32 |
| 0 | 1000 | 0 | 100 |

(*): Determined by quantitative TLC; Iatroscan Method.

We claim:

1. A method of controlling pitch deposits in a pulp and papermaking process comprising:

adding lipase and a cationic polymer to a triglyceride-containing papermaking cellulosic slurry, said cellulosic slurry having an aqueous phase, wherein said lipase is added in an amount effective to reduce the content of said triglyceride in said cellulosic slurry by hydrolysis of said triglyceride to glycerol and fatty acids, wherein said triglyceride content reduction diminishes pitch deposits from said cellulosic slurry in a pulp and/or paper mill, and said cationic polymer is added in an amount effective to enhance said diminishing of pitch deposits activity of said lipase at least in part by diminishing the concentration of said fatty acids in said aqueous phase of said cellulosic slurry.

2. The method of claim 1 wherein said cellulosic slurry is at an elevated temperature at the time said lipase and said cationic polymer are added thereto, and then is held at an elevated temperature during an incubation period.

3. The method of claim 2 wherein said elevated temperature of said cellulosic slurry is from about 35° C. to about 55° C. at the time of the addition of said lipase and said cationic polymer, and said incubation period is a time period of from about 1.5 to about 4 hours after said lipase and said cationic polymer have been added to said cellulosic slurry.

4. The method of claim 1 wherein said cellulosic slurry has a pH within a range of about 4 to about 7 during said incubation period to effectuate a degree of triglyceride hydrolysis.

5. The method of claim 4 wherein said pH is from about 4.5 to about 6.5.

6. The method of claim 1 wherein said cationic polymer is added to said cellulosic slurry as an aqueous solution of polymer actives, containing from about 0.05 to about 0.5 weight percent of said cationic polymer actives and wherein said cationic polymer is added to said cellulosic slurry in the amount of from about 10 to about 100 parts per million based on the weight of cationic polymer actives in comparison to the dry weight of solids in said cellulosic slurry.

7. The method of claim 1 wherein said cationic polymer is added to said cellulosic slurry in the amount of from about 10 to about 80 parts per million based on the weight of cationic polymer in comparison to the dry weight of solids in said cellulosic slurry.

8. The method of claim 1 wherein said cellulosic slurry is a mechanical pulp, a thermo-mechanical pulp or a mixture thereof.

9. The method of claim 1 wherein the weight average molecular weight of said cationic polymer is at least 500,000.

10. A method of controlling pitch deposits in a pulp and papermaking process employing a cellulosic slurry that contains triglyceride comprising:

adding lipase and a cationic polymer to said cellulosic slurry in amounts effective for both reducing said triglyceride content of said cellulosic slurry by hydrolysis and diminishing the concentration of fatty acids released by said hydrolysis in the aqueous phase of said cellulosic slurry, whereby an enhanced control of pitch deposits is achieved, wherein said cationic polymer is added to said cellulosic slurry in the amount of from about 10 to about 80 parts per million based on the weight of cationic polymer actives in comparison to the dry weight of solids in said cellulosic slurry.

* * * * *